220-270 SR

6/2/87 XR 4,669,630

United States Patent [19]

Kenyon, 2nd

[11] Patent Number: 4,669,630

[45] Date of Patent: Jun. 2, 1987

[54] CONTAINER AND CAP ASSEMBLY

[75] Inventor: Maynard A. Kenyon, 2nd, Mercerville, N.J.

[73] Assignee: General Foods Corporation, White Plains, N.Y.

[21] Appl. No.: 863,207

[22] Filed: May 14, 1986

[51] Int. Cl.[4] ..... B65D 17/40

[52] U.S. Cl. ..... 220/276; 220/270; 220/306; 215/256

[58] Field of Search ..... 220/270, 276, 306, 380; 215/256, 320, 321

[56] References Cited

U.S. PATENT DOCUMENTS

| | | | |
|---|---|---|---|
| 3,753,511 | 8/1973 | Ruch | 215/256 |
| 4,066,182 | 1/1978 | Allen et al. | 215/256 |
| 4,281,774 | 8/1981 | Mumford | 220/270 |
| 4,362,253 | 12/1982 | Wortley et al. | 220/276 |
| 4,565,294 | 1/1986 | Smith | 215/256 |

*Primary Examiner*—George T. Hall

*Attorney, Agent, or Firm*—Barbara Toop D'Avanzo; Thomas R. Savoie; Daniel J. Donovan

[57] ABSTRACT

A recloseable, tamperproof container and cap assembly, wherein the outer leg of the cap is comprised of an upper skirt and a lower skirt, the lower skirt providing the tamperproof means. When the lower skirt is removed, a section of it remains, and act as a lifting tab, for easy access to the contents of the container.

5 Claims, 6 Drawing Figures

FIG.1
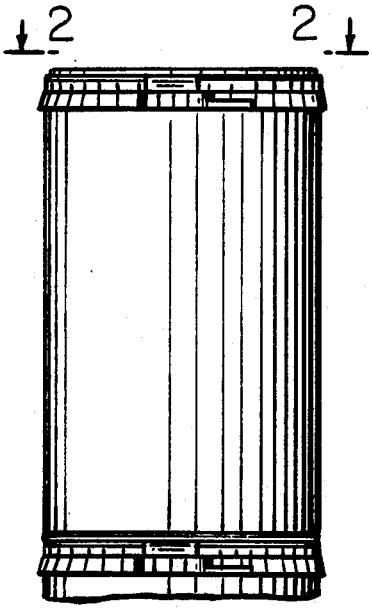
FIG.2
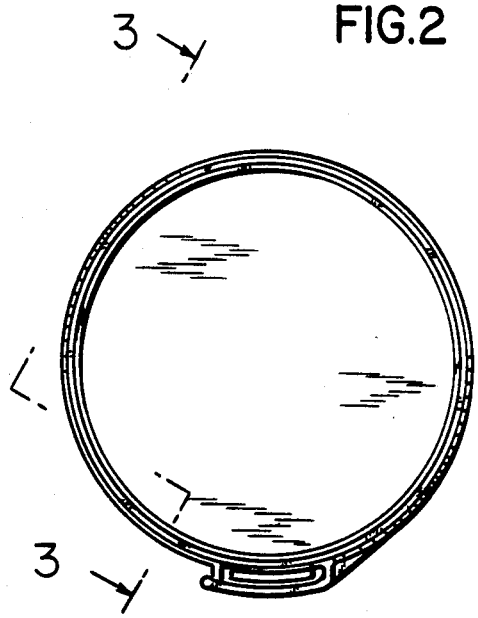
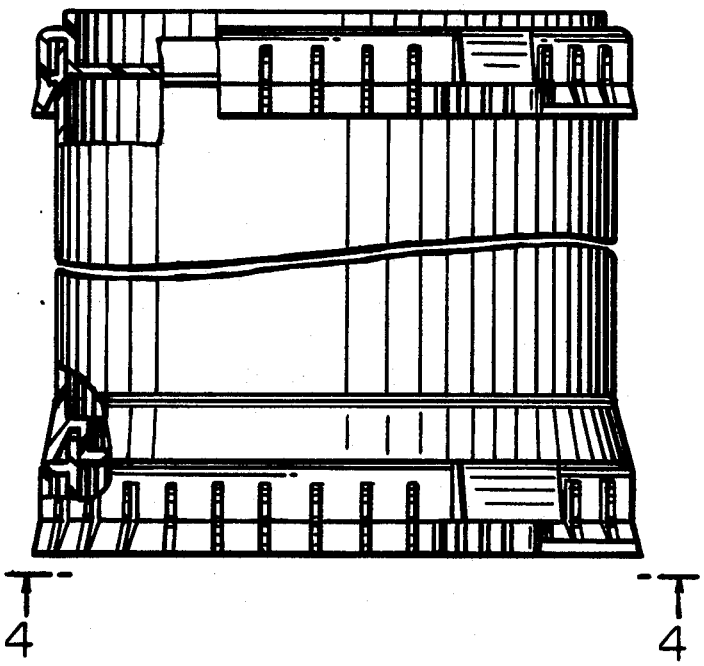
FIG.3

CONTAINER AND CAP ASSEMBLY

TECHNICAL FIELD

This invention relates to a container and cap assembly which is tamperproof and reclosable. The cap comprises a lifting tab for easy access to the contents thereof.

BACKGROUND OF THE INVENTION

Plastic closures with tamperproof bands are well known in the prior art. In general, the lower portion of the closure skirt locks around a circumferential bead or flange projecting from the outside surface of the container wall, just below the rim. The lower part of the skirt, below the protruding container bead or flange, forms a tamperproof band which must be removed before the container may be opened. Many different designs have been developed for permitting easy removal of the tamperproof band. Typically, the skirt is weakened by score lines on which the band may be torn away. Further, a tab is usually provided which the user may grasp to being pulling the tamperproof band from the remainder of the closure. To make the tab accessible, the prior art has variously employed such methods as perforating an area around the tab, thickening the skirt walls near the tab, and forming an enlarged tab extending below the bottom of the skirt.

For example, U.S. Pat. No. 3,856,171 to Rossi discloses a tab partially cut away from the skirt and connected by a plurality of frangible strips, and a thickened skirt wall near the tab. U.S. Pat. No. 3,753,511 to Ruch discloses a similar band and tab, with a weakening score line formed on the outside of the skirt. In addition, U.S. Pat. No. 4,281,774 to Mumford discloses a protruding section of skirt acting as an opening tab, resulting from a discontinuous groove on the interior side thereof.

SUMMARY OF THE INVENTION

The container and cap disclosed herein provide a tamperproof, reclosable container. The container is provided with a peripheral flange below the rim, said rim defining the container opening. The cap has a generally inverted U-shaped seating section to fit over the rim of the container. The seating section has a circumferential inner leg and circumferential outer leg, said outer leg spaced from the inner leg by approximately the container sidewall thickness. The outer leg is provided with an upper and lower portion, referred to as skirts, the portions being differentiated by a continuous horizontal score line. A section of the lower skirt has a horizontal tab extending therefrom which acts as a lifting tab. In addition, connected to the lower skirt adjacent to the lifting tab, is an extending member which extends around said lifting tab. This extending member is the means for grasping and pulling so as to separate the lower skirt from the upper skirt along the score line. The cap may also be provided with a stacking means extending circumferentially upward from the point where the inner leg of the seating section adjoins the outer leg of the seating section. This stacking means fits with a receiving means on the bottom portion of the container, or stacks within the U-shaped seating section of another lid.

BRIEF DESCRIPTION OF THE DRAWINGS

FIG. 1 is a side plan view of the container and cap assembly stacked on another assembly.

FIG. 2 is a top plan view of the cap taken along lines 2—2 of FIG. 1.

FIG. 3 is a partial cross-sectional view taken along line 3—3 of FIG. 2.

DETAILED DESCRIPTION

Figure 4:
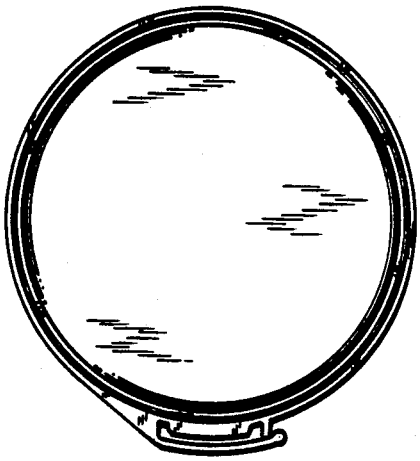
FIG. 4 is an internal view of the cap taken along line 4—4 of FIG. 3.

As illustrated in the drawings, the invention comprises a container 10 with a cap 20. The container and cap may be made of any number of semi-elastic materials, but a thermoplastic container and cap assembly is preferred, preferably polyolefins, such as polyethylene and polypropylene, and more preferably high density polyethylene. The cap 20 comprises a central flat portion 21 and a generally U-shaped seating section, said section comprising an inner leg 22 and an outer leg 23. The outer leg 23 is spaced from the inner leg 22 by just less than the thickness of the sidewall of the container, about 0.005–0.001 inches less than the thickness of the sidewall, and preferably 0.003 inches less.

The outer leg 23 comprises two portions, an upper portion 25, referred to as the upper skirt, and a lower portion 26, referred to as the lower skirt. A continuous horizontal score 30 is the line of differential between the upper and lower skirts. The outer leg 23 also comprises vertical ribs 35, seen most clearly in FIG. 6. The ribs allow for easy manufacture of the cap.

The cap and closure interact by means of an interference fit. Due to the nature of the interferance or friction fit, a hermetic seal is formed. Even after the lower skirt is removed, and the cap resealed, a hermetic seal is still formed due to the seat section of the cap having a width less than the thickness of the sidewalls of the container. The container has a peripheral flange 40 extending radially outward from the sidewall of the container. The flange is positioned on the sidewall at a distance from the top of the container which is approximately the same as the vertical length of the upper skirt 25 of the outer leg 23 of the cap 20. This provides the reclosable means.

The lower skirt portion is provided with a lifting tab section 41, which is defined by two vertical scores 42. A vertical score is placed on either side of the lifting tab section, so that when the lower skirt is removed, the lifting tab section remains attached to the upper skirt, and acts as a lifting means to access the container. A horizontally-extending lifting tab 44 is adjacent to the bottom end of the lifting tab section, providing ease of use. The horizontal tab also provides a visual aid, so the consumer may easily locate the lifting tab portion of the cap. This eliminates the need to grip the cap with one's fingers and eliminates the catching of fingertips and fingernails on the flange 40. An extending member 50 is adjoined to the lower skirt 26 of the outer leg 23 at a point adjacent to one of the vertical scores 42. This extending member extends around the lifting tab section 41 and adjoins a strut 45 on the opposite side of the lifting tab section 41.

Figure 5:
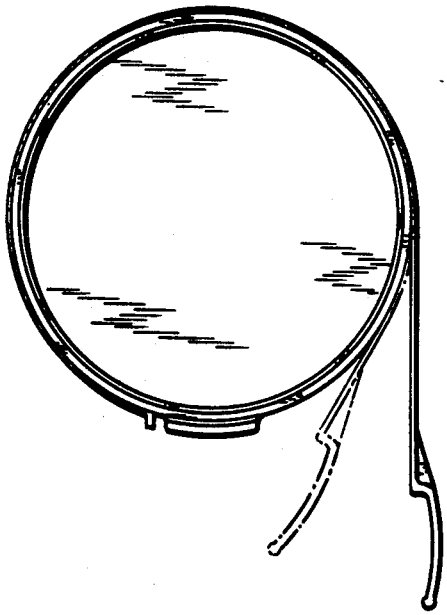
FIG. 5 is a top plan view of the cap showing the lower skirt being torn away.
Figure 6:
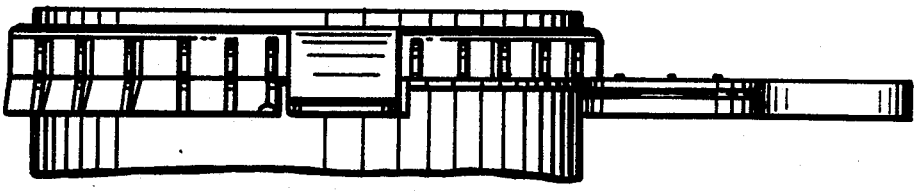
FIG. 6 is a perspective view of the lower skirt being torn away.

The strut 45 extends perpendicularly out from the lower skirt 26 of the outer leg 23 adjacent to the second vertical score 42. To remove the cap 20 from the container 10, the extending member 50 is ripped away from the strut 45, and the lower skirt 26 is the pulled away from the upper skirt 25, as illustrated in FIGS. 5 and 6. The breaking of the bond between the strut 45 and the extending means 50 is evidence of an attempt to open the container. It is very difficult to remove the cap from the container without tearing the extending member 50 from the strut 45.

Also provided on this cap is a stacking ring 60, best illustrated in FIG. 6. The stacking ring 60 extends radially upward from the U-shaped seating section of the cap. The stacking ring 60 is positioned at or near the point where the inner leg 22 adjoins the outer leg 23. The stacking ring is important in two phases of the product; in manufacturing and in retailing. As the lids are being manufactured they are stacked one upon another, and the stacking ring 60 fits into the U-shaped seating section of the next lid. Once the container and cap are assembled, the stacking ring fits into a corresponding U-shaped receiving means 61 on the bottom of the container. This stacking ring increases the stability of the stacked product. Thus, the stacking ring provides for ease of handling from manufacturing and distribution and thorugh the consumer.

What is claimed is:

1. A reclosable container and cap assembly, comprising:

a container having an opening defined by an annular rim;

a peripheral flange below said rim, extending radially outward therefrom;

a cap having a central flat portion and a generally inverted U-shaped seating section to fit over the rim of a sidewall of the container, said seating section having a circumferential inner leg and a circumferential outer leg, said outer leg spaced from said inner leg by a distance less than thickness of the sidewall of the container;

said outer leg having an upper and lower portion with a continuous horizontal score being the line of differential between the two;

said upper portion of the outer leg fitting over the peripheral flange;

a lifting tab section defined on the lower portion of the outer leg by two vertical scores;

a horizontally-extending lifting tab adjacent to the bottom end of the lifting tab section;

an extending member adjoined to the lower portion of the outer leg at a point adjacent to one vertical score;

a strut extending perpendicularly out from the lower portion of the outer leg adjacent to the second vertical score, wherein the extending member extends around the lifting tab section and adjoins the strut.

2. A container and cap assembly, as set forth in claim 1, which further comprises a stacking ring on the cap, said stacking ring extending radially upward from the U-shaped seating section on the cap, at or near the point where the inner leg adjoins the outer leg.

3. The container and cap assembly set forth in claim 2, which is constructed of an olefin.

4. The container and cap assembly set forth in claim 2, which is constructed of high density polyethylene.

5. The container and cap assembly as set forth in claim 2 wherein the distance between the outer leg and the inner leg is less than the thickness of the sidewall of the container by from about 0.005 inches to about 0.001 inches.

* * * * *